US009076409B2

(12) United States Patent
Yamada

(10) Patent No.: US 9,076,409 B2
(45) Date of Patent: Jul. 7, 2015

(54) DISPLAY CONTROL METHOD, DISPLAY CONTROL DEVICE AND PROGRAM

(75) Inventor: Yusuke Yamada, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 586 days.

(21) Appl. No.: 13/097,022

(22) Filed: Apr. 28, 2011

(65) Prior Publication Data

US 2011/0285725 A1 Nov. 24, 2011

(30) Foreign Application Priority Data

May 19, 2010 (JP) ..... 2010-115761

(51) Int. Cl.
*G09G 5/40* (2006.01)

(52) U.S. Cl.
CPC ..... *G09G 5/40* (2013.01); *G09G 2320/0257* (2013.01)

(58) Field of Classification Search
CPC ..... G09G 3/344; G09G 3/3446
See application file for complete search history.

(56) References Cited

U.S. PATENT DOCUMENTS

| | | | | |
|---|---|---|---|---|
| 2003/0043134 | A1 | 3/2003 | Cairns et al. | |
| 2005/0122327 | A1 * | 6/2005 | Greve | 345/467 |
| 2008/0266244 | A1 * | 10/2008 | Bai et al. | 345/107 |
| 2009/0128566 | A1 | 5/2009 | Okuno et al. | |
| 2009/0153451 | A1 * | 6/2009 | Takama et al. | 345/84 |
| 2010/0171752 | A1 * | 7/2010 | Kim et al. | 345/589 |
| 2010/0172017 | A1 * | 7/2010 | Kim et al. | 359/296 |
| 2010/0207924 | A1 * | 8/2010 | Saito | 345/211 |

FOREIGN PATENT DOCUMENTS

| | | | |
|---|---|---|---|
| CN | 101213588 | A | 7/2008 |
| JP | 05-289646 | A | 11/1993 |
| JP | 09-258704 | A | 10/1997 |
| JP | 2003-177728 | A | 6/2003 |
| JP | 2008-257551 | | 10/2008 |
| JP | 2009-237395 | | 10/2009 |

* cited by examiner

*Primary Examiner* — Kee M Tung
*Assistant Examiner* — Ryan D McCulley
(74) *Attorney, Agent, or Firm* — Maschoff Brennan

(57) ABSTRACT

A display control method for controlling display of characters in a display section equipped with a plurality of pixels, includes: acquiring character data; and displaying a character according to the character data in a character display region of the display section. The character corresponding to the character data is displayed in the character display region by using a plurality of pixel groups each having a predetermined shape.

7 Claims, 17 Drawing Sheets

DISPLAY CONTROL METHOD, DISPLAY CONTROL DEVICE AND PROGRAM

BACKGROUND

1. Technical Field

The present invention relates to display control methods, display control devices and programs.

2. Related Art

A display using an electrophoretic method is known. The display includes a substrate with a common electrode formed thereon, another substrate with pixel electrodes formed for corresponding respective pixels, and microcapsules, each containing electrophoretic material liquid, arranged for the corresponding respective pixels disposed between the substrates (see, for example, JP-A-2009-237395 (Patent Document 1)). According to such a display, particles contained in the microcapsules are moved by application of voltage to the pixel electrodes of pixels corresponding to display data, whereby the pixels corresponding to the display data can be colored and displayed as the display data. In this connection, a software keyboard that displays a keyboard for inputting characters on a screen is known. When keys among the displayed keyboard are selected, the selected keys are displayed in a character input field for buffering (see, for example, JP-A-2008-257551 (Patent Document 2)).

In the case of the display using an electrophoretic method as described in Patent Document 1, when a currently displayed image is switched to a new image, the last image displayed remains as an afterimage on the screen, because of the structure of the display. Such a display may be used for displaying the software keyboard described in Patent Document 2. In this case, however, even when a displayed character is erased, an afterimage of the erased character remains and displayed on the screen. When input of characters and erasure of the characters are repeated, afterimages of multiple characters that have been erased are displayed on the screen, overlapping each other. Such afterimages stand out in the character display region, which would give the user a feeling that something is wrong.

SUMMARY

In accordance with an advantage of some aspects of the invention, it is possible to provide display control methods, display control devices and programs, which make afterimages of erased characters inconspicuous even when erasure and input of characters are continuously performed, thereby mitigating the feeling of wrongness that may be perceived by the user.

A display control method in accordance with a first embodiment of the invention pertains to a display control method for controlling display of characters in a display section equipped with a plurality of pixels. The display control method includes a character acquisition step of acquiring character data, and a display control step of displaying a character according to the character data acquired in the character acquisition step in a character display region of the display section. In an aspect of the embodiment, in the display control step, a plurality of pixel groups each having a predetermined shape are used to display a character corresponding to the character data acquired in the character acquisition step, in the character display region. According to the display control method of the embodiment, even when a character is erased and an afterimage of the character remains, the afterimage can be formed from a combination of a plurality of the pixel groups having a predetermined shape. Also, it is possible to display a newly inputted character, overlapping the afterimage of the erased character in the unit of pixel group. Among the afterimage of the erased character, any portion of the afterimage which appear in pixel groups that overlap a portion of pixel groups among the plurality of pixel groups composing the newly inputted character are overwritten by the portion of the image of the newly inputted character. Further, among the afterimage of the erased character, any portion of the afterimage which appears in pixel groups that do not overlap any portion of the plurality of pixel groups composing the newly inputted character can be made inconspicuous, which alleviates a feeling of wrongness that may be perceived by the user.

In the display control method described above, the character display region may have a plurality of partial regions each including a plurality of the pixel groups for displaying a character, and in the display control step, one of characters corresponding to the character data acquired in the character acquisition step may be displayed in one of the partial regions. With such a composition, an afterimage would not be displayed in a region other than the partial regions, or an afterimage would not be displayed in a manner bridging across a plurality of the partial regions, such that the afterimage can be made more inconspicuous and a feeling of wrongness that may be perceived by the user can be alleviated.

In the display control method described above, in the character display region, adjacent two of the pixel groups may be separated from each other by providing pixels therebetween that are not used for displaying a character. By such a composition, when the pixel groups are displayed in color, for example, when characters are displayed, the contour of the pixel groups can be relatively emphasized, which can provide the benefit of emphasizing the characters displayed in the character display region.

In the display control method described above, each of the plurality of pixel groups may have a display segment configuration. With such a structure, each of the plurality of pixel groups is formed in a display segment configuration that has been used in display devices, such that afterimages of erased characters are made more inconspicuous, and a feeling of wrongness that may be perceived by the user can be alleviated.

In the display control method described above, each of the plurality of pixel groups may have a dot configuration. With such a structure, each of the plurality of pixel groups is formed in a dot configuration that has been used in display devices in related art, such that afterimages of erased characters are made more inconspicuous, and a feeling of wrongness that may be perceived by the user can be alleviated.

In the display control step in the display control method described above, prior to displaying a character according to the character data acquired in the character acquisition step, each of the plurality of pixel groups may be preliminarily displayed with a gradation level different from a gradation level of the character to be displayed. With such a structure, any of the pixel groups that are not used for displaying the character already have a generated afterimage, such that an afterimage that is generated upon erasing the character would be mingled with the afterimage generated at the pixel groups that have not been used for displaying the character. Therefore, afterimages that are generated when characters are erased can be made more inconspicuous. Also, when writing and erasing of characters are repeated, afterimages may be accumulated, whereby the afterimages may appear in different densities depending on the pixel groups. However, according to the present embodiment, prior to displaying characters, an afterimage has already been generated at each of the plurality of pixel groups. Therefore an unpleasant feeling that may be perceived by the user due to the unevenness in density can be reduced. Moreover, pixel groups that are used for displaying characters have a gradation level different from that of pixel groups that are not used for displaying the characters, such that the user can readily recognize the characters displayed.

A display control device in accordance with a second embodiment of the invention pertains to a display control device for controlling display of characters in a display section equipped with a plurality of pixels. The display control device includes a character acquisition section that acquires character data, and a display control section that displays a character according to the character data acquired by the character acquisition section in a character display region of the display section. In an aspect of the embodiment, the display control section uses a plurality of pixel groups each having a predetermined shape to display a character corresponding to the character data acquired by the character acquisition section in the character display region. According to the display control device in accordance with the second embodiment, even when a character is erased and an afterimage of the character remains, the afterimage can be formed from a combination of a plurality of the pixel groups having a predetermined shape. Also, it is possible to display a newly inputted character, overlapping the afterimage of the erased character in the unit of each pixel group. Among the afterimage of the erased character, any portion of the afterimage which appears in pixel groups that overlap a portion of pixel groups among the plurality of pixel groups composing the newly inputted character are overwritten by the portion of the image of the newly inputted character. Further, among the afterimage of the erased character, any portion of the afterimage which appears in pixel groups that do not overlap any portion of the plurality of pixel groups composing the newly inputted character can be made inconspicuous, which alleviates a feeling of wrongness that may be perceived by the user.

A program in accordance with a third embodiment of the invention renders a computer to function as a character acquisition device that acquires character data, and a display control device that displays a character according to the character data acquired by the character acquisition device in a character display region of a display section, such that the display control device displays a character corresponding to the character data acquired by the character acquisition device, using a plurality of pixel groups each having a predetermined shape. According to the program of the third embodiment, the computer executes the program such that, even when a character is erased and an afterimage of the character remains, the computer can form the afterimage from a combination of a plurality of the pixel groups having a predetermined shape. Also, it is possible to display a newly inputted character, overlapping the afterimage of the erased character in the unit of each pixel group. By this, among the afterimage of the erased character, any portion of the afterimage which appears in pixel groups that overlap a portion of pixel groups among the plurality of pixel groups composing the newly inputted character are overwritten by the portion of the image of the newly inputted character. Further, among the afterimage of the erased character, any portion of the afterimage which appear in pixel groups that do not overlap any portion of the plurality of pixel groups composing the newly inputted character can be made inconspicuous, which alleviates a feeling of wrongness that may be perceived by the user.

DESCRIPTION OF EXEMPLARY EMBODIMENTS

Embodiment 1

Figure 1:
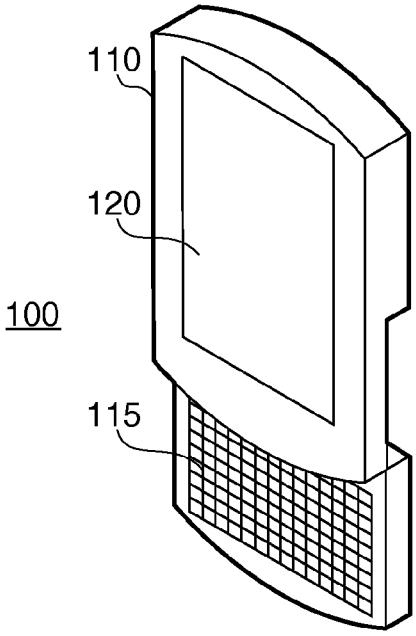
FIG. 1 is a perspective view showing an example of the external appearance of a display device 100 in accordance with Embodiment 1.

FIG. 1 shows an example of the external appearance of a display device 100 in accordance with Embodiment 1. The display device 100 is an example of a display control device in accordance with the invention. The display device 100 may be, for example, a personal digital assistant (PDA), a portable phone, an electronic book, a portable music player device, a portable video player device, a portable navigation device, or the like, which is capable of displaying character data. Without any limitation to the above, the display control device in accordance with the invention may be any device that is capable of displaying at least character data, and may be realized by a notebook PC (Personal Computer), a desktop PC or the like.

The display device 100 is equipped with a housing 110, a keyboard 115 that is an example of an input section, and a display 120 that is an example of a display section. The housing 110 stores various kinds of hardware for operating the display device 100, such as, a power supply, a CPU, a memory, a hard disk, a keyboard 115, the display 120, and a display drive circuit 122.

The keyboard 115 has a plurality of input keys. As the plural input keys are operated by the user, the keyboard 115 inputs characters or control signals according to the operated input keys in the display device 100.

The display 120 is driven by the display drive circuit 122 (see FIG. 18), and displays characters according to character data inputted by the keyboard 115. The display 120 is also capable of displaying documents, images, management information, buttons and icons, in addition to characters according to character data inputted by the keyboard 115. The display device 100 in accordance with Embodiment 1 uses an electronic paper utilizing an electrophoretic system as the display 120. The display 120 may be equipped with a display device of a different type, such as, a liquid crystal display, a plasma display, an organic EL display, or the like, as the display section.

The display device 100 may be provided with an input section other than the keyboard. For example, a touch panel may be provided, superposed on the display surface of the display 120. In the case of this display device 100, character data may be inputted through the touch panel. The display device 100 may not be provided with an input section for inputting character data. In other words, the display device 100 may be of the type in which character data is inputted externally, or may be of the type without a function of inputting character data.

Figure 2:
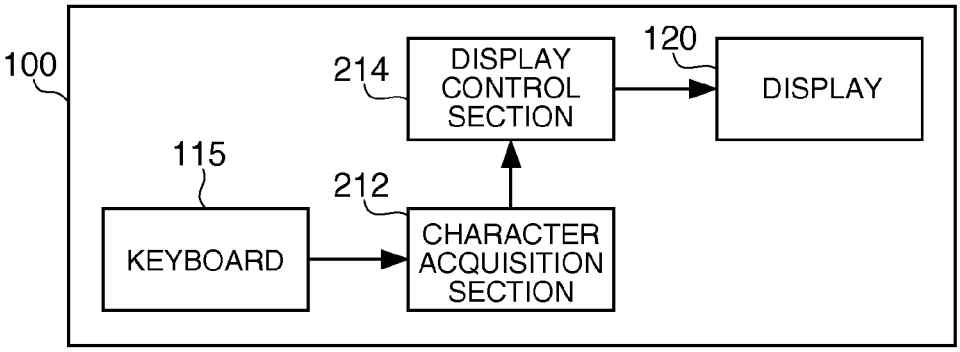
FIG. 2 is an exemplary functional diagram of the display device 100.

FIG. 2 shows an example of the functional structure of the display device 100. The display device 100 is equipped with a character acquisition section 212, and a display control section 214. The character acquisition section 212 acquires character data. More specifically, the character acquisition section 212 acquires character data inputted by the keyboard 115. Characters to be displayed on the display 120 are not limited to those inputted by the keyboard 115. For example, the display device 100 may display characters on the display 120 generated as a result of software processing that accompanies displaying. In this case, the character acquisition section 212 may acquire characters to be displayed on the display 120 from the CPU, a memory, or an external device.

The display control section 214 controls display of various kinds of data by the display 120. For example, when the character acquisition section 212 acquires character data, the display control section 214 controls the display 120 to display characters according to the character data acquired by the character acquisition section 212. More specifically, the display control section 214 makes characters according to the character data acquired by the character acquisition section 212 to be displayed in a character display region of the display 120.

The character display region may be a region on the main screen where characters inputted after a document that is already displayed can be displayed, like in document creation software. Also, the character display region may be a region on an auxiliary screen that is superposed on or is provided next to the main screen, such as, a pup-up screen for inputting search keywords, a tool bar or the like.

The display control section 214 in accordance with Embodiment 1 uses a plurality of pixel groups each having a predetermined shape to display characters according to character data acquired by the character acquisition section 212 in the character display region. Here, a pixel group is an aggregation of pixels composed of a plurality of pixels. More specifically, the display control section 214 uses pixel groups to display characters in the character display region, and does not use pixels that are not included in the pixel groups among the plurality of pixels included in the character display region. Further, the display control section 214 selectively displays one pixel group or a plurality of pixel groups to display one character in the character display region.

For example, each of the plural pixel groups may use a display segment configuration. For example, the shape of each of the pixel groups may have a rectangular or a parallelogram segment shape that is composed of a plurality of pixels in n columns x n rows. In this case, the shape of the pixel group may not be in perfect rectangle or parallelogram, but may be modified by rounding the corners, cutting the corners and the like. Also, the pixel groups may include pixels in part thereof that are not used for display, and may be constituted such that, when the pixel groups are displayed, the pixels that are not used for display appear as a gap or a pattern.

As another example, each of the plural pixel groups may use a dot configuration. For example, the shape of each of the pixel groups may have a square shape that is composed of a plurality of pixels. In this case, the shape of the pixel group may not be in perfect square, but may be modified by rounding the corners, cutting the corners and the like. In the case of forming each pixel group from a dot configuration, the pixel groups may also include pixels in part thereof that are not used for display, and may be constituted such that, when the pixel groups are displayed, the pixels that are not used for display appear as a gap or a pattern.

It is noted that each of the plural pixel groups is not limited to a display segment configuration or a dot configuration. Each of the plural pixel groups may have any shape as long as the pixel groups form a character when combined.

The character display region may include a plurality of partial regions, each for displaying one character. Each of the partial regions includes a plurality of pixel groups. In this case, the display control section 214 may control each of the partial regions to display one character according to character data acquired by the character acquisition region 212. For example, the character display region may be provided with p partial regions. In this case, the display control section 214 may control each of the partial regions to display one character according to character data obtained by the character acquisition region 212, such that a maximum of p characters can be displayed in the character display region. Also, the character display region may be provided with a plurality of partial regions in q columns×r rows. In this case, the display control section 214 may control each of the partial regions to display one character according to character data obtained by the character acquisition region 212, such that a maximum of q×r characters can be displayed in the character display region.

It is noted that the character display region may not have partial regions, like those described above. In this case, limitations to the number of characters and the width of each character to be displayed in the character display region are removed, such that the display control section 214 can display a greater number of characters in the character display regions, and display characters with a greater width can be displayed in the character display region.

In the character display region, two adjacent ones of the pixel groups may be provided therebetween with pixels that are not used for displaying characters, thereby being separated from each other. In order to color a pixel with a predetermined gradation level, a predetermined drive voltage is supplied to the pixel. However, the pixel may not be colored with the predetermined gradation level depending on the display history of the pixel. Therefore, when two adjacent ones of the pixel groups are to be colored with the same gradation level, the gradation levels may differ between the two pixel groups, even when the gradation level in each of the pixel groups is uniform. In this case, the difference in gradation level between the two pixel groups can be recognized unless a non-colored region that is recognizable by the user is provided between the two adjacent pixel groups. This may give the user an unpleasant feeling. However, in accordance with the present embodiment, the pixels that are not used for displaying characters are provided between the two adjacent pixel groups each having a uniform gradation level, respectively. Therefore, even when there is a difference in gradation level between the two adjacent pixel groups, the difference in gradation level is harder to be recognized. Accordingly, the unpleasant feeling perceived by the user can be reduced.

Before displaying characters acquired by the character acquisition section 212, the display control section 214 may control each of the plural pixel groups to display preliminarily with a gradation level different from the gradation level with which the characters are displayed. For example, before displaying characters according to character data acquired by the character acquisition section 212, the display control section 214 may control each of the plurality of pixel groups to display preliminarily with a lighter density (gradation) than that with which the characters are displayed. The display control section 214 may control each of the plural pixel groups to display a black color, and then switch the display of each of the plurality of pixel groups to a white color, thereby leaving an afterimage at each of the plural pixel groups. The afterimage created at this moment has a gradation level intermediate between the black color and the white color. By this operation, the afterimage has already been created at pixel groups that are not used for displaying characters, such that an afterimage to be generated upon erasing the characters will be mingled with the afterimage that has been present at the pixel groups that were not used for displaying characters. Therefore, the afterimage that is generated upon erasing the characters can be made more inconspicuous. Also, when writing and erasing of characters are repeated, afterimages may be accumulated, whereby the afterimages may appear in different densities depending on the pixel groups. However, according to the present embodiment, prior to displaying characters, an afterimage has already been generated at each of the plurality of pixel groups. Therefore an unpleasant feeling that may be perceived by the user due to the unevenness in density can be reduced. Moreover, pixel groups that are used for displaying characters have a gradation level different from that of pixel groups that are not used for displaying the characters, such that the user can readily recognize the characters displayed. It is noted that, when an afterimage is left remained at one of the pixel groups, it is not necessary to leave the afterimage on the entire pixels included in the one of the pixel groups. It is only necessary to leave an afterimage in a region generally corresponding to the shape of each pixel group such that an afterimage to be generated upon erasing a character becomes more inconspicuous.

Figure 3:
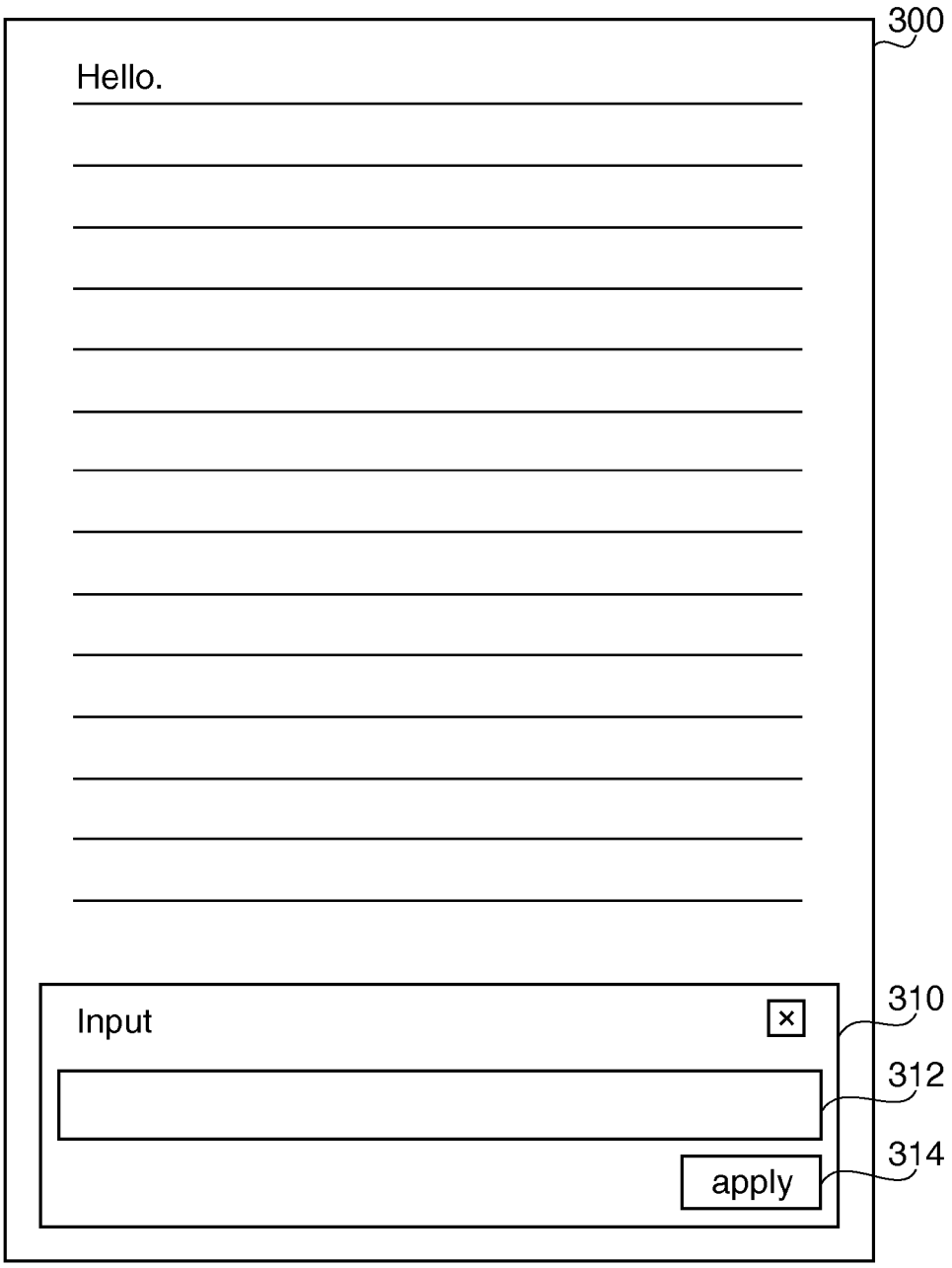
FIG. 3 shows an example of a screen displayed on a display 120.

FIG. 3 shows an example of the screen shown in the display 120. The display 120 displays a main screen 300. For example, the main screen 300 is a display screen of document software that creates and displays documents. For example, the main screen 300 displays a document that has already been created. Also, a new document may be created by using characters inputted by the keyboard 115. Alternatively, a document that has already been created may be edited by using characters inputted from the keyboard 115.

An auxiliary screen 310 is displayed superposed on the main screen 300. As the auxiliary screen 310 is displayed, the user is urged to input characters. The auxiliary screen 310 has a character input frame 312. The character input frame 312 is an example of the character display region in accordance with the present embodiment of the invention. When characters according to character data are inputted by the keyboard 115 in the state in which the auxiliary screen 310 is displayed, the inputted characters according to the character data are displayed within the character input frame 312. As a confirmation button 314 is depressed in the state in which the characters are displayed in the character input frame 312, the characters displayed in the display input frame 312 are displayed at a predetermined position in the main screen 300.

At this moment, the display control section 214 may partially drive pixel electrodes, thereby displaying the characters within the character input frame 312. Also, the display control section 214 may drive the entire pixel electrodes of the display 120, thereby displaying the characters at a predetermined position of the main screen 300. By such operations, the driving time and power consumption of the pixel electrodes for displaying the characters can be suppressed. Without any limitation to the above, the display control section 214 may drive the entire pixel electrodes of the display 120, thereby displaying the characters within the character input frame 312. Also, the display control section 214 may partially drive the pixel electrodes of the display 120, thereby displaying the characters at a predetermined position of the main screen 300.

Referring to FIG. 3, a structure example in which characters are inputted in the main screen 300 through the auxiliary screen 310 has been described. However, without any particular limitation to the above, it can be structured such that characters are directly inputted in the main screen 300 without using the auxiliary screen 310. In this case, the character display region may be a region corresponding to a row being currently edited among a document that is shown in the main screen 300 and is edited, and the auxiliary screen 310 may not have to be displayed. Also, the character display region in accordance with the embodiment of the invention may be provided on the main screen 300.

It is noted that the auxiliary screen 310 may be normally displayed while the main screen 300 is displayed. Alternatively, the auxiliary screen 310 may be displayed when the main screen 300 is displayed, and the display device 100 moves into a character input mode (the mode in which the user inputs characters). Also, the auxiliary screen 310 may be displayed juxtaposed to the main screen. Also, the auxiliary screen 310 is not limited to the function for confirming characters that are to be displayed on the main screen 300, but may be used for other functions that require character input, such as, inputting search keywords and the like.

Figure 4:
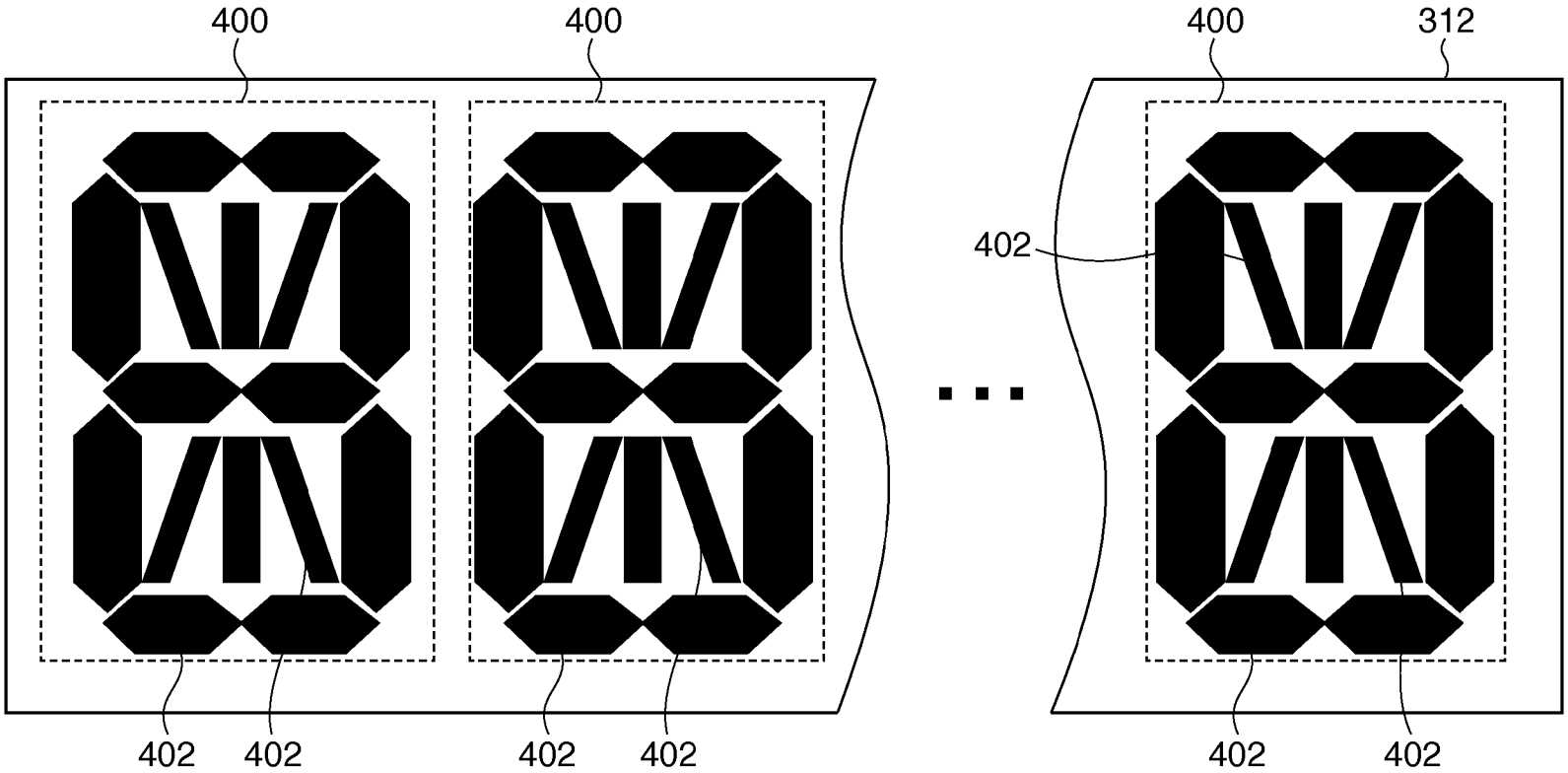
FIG. 4 shows an exemplary composition of a character input frame 312.

FIG. 4 shows an exemplary structure of the character input frame 312. In the character input frame 312, plural partial regions 400 are laterally arranged in one row with predetermined gaps provided therebetween. The display control section 214 renders each of the partial regions 400 to display a single character. Each of the partial regions 400 includes a plurality of pixel groups 402. In the example shown in FIG. 4, each of the plural pixel groups 402 has a display segment configuration. Also, each of the partial regions 400 may have a plurality of pixel groups 402 having mutually different shapes in order to display an English alphabet or an Arabic numeral, as shown in FIG. 4. FIG. 4 shows an example in which the entire pixel groups 402 are driven to display. In FIG. 4, colored portions indicate regions composed of plural pixels to be used for displaying characters (in other words, a plurality of pixel groups 402). On the other hand, uncolored portions indicate regions composed of plural pixels that are not to be used for displaying characters (in other words, regions other than the plurality of pixel groups 402). The display control section 214 selectively combines the plurality of pixel groups 402 to be displayed as characters.

As shown in FIG. 4, adjacent two of the pixel groups 402 are separated from each other by providing pixels that are not used for displaying characters (in other words, pixels that do not display characters or afterimages) between them. With such a structure, when characters are displayed, and a plurality of pixel groups 402 that are used for displaying the characters are colored, outlines of these plural pixel groups 402 can be relatively enhanced. As a result, it is possible to obtain the effect of enhancing characters displayed in the character input frame 312. It is noted that a cursor and control characters such as punctuations can be displayed in the character input frame 312. The display control section 214 may make control characters to be displayed in the partial regions 400. In this case, the display control section 214 may use the pixel groups 402 to display control characters in the partial regions 400, or may use pixels other than the pixel groups 402 to display control characters.

The partial regions 400 and the plural pixel groups 402 may differ from one another in shape and size depending on the font size of characters to be displayed in the character input frame 312, and the complexity of the characters. For example, the greater the font size of characters to be displayed in the character input frame 312, the greater the size of each of the plural pixel groups 402 may be made, and the greater the size of the partial regions 400 may be made accordingly. As another example, the greater the font size of characters to be displayed in the character input frame 312, the greater the size of each of the partial regions 400 may be made, and the greater the number of pixel groups 402 within each of the partial regions 400 may be made accordingly. As still another example, when more complex characters such as Kanji characters are to be displayed in the character input frame 312, the size of the pixel groups 402 within each of the partial regions 400 may be made smaller accordingly, and the number thereof may be increased.

Figure 5:
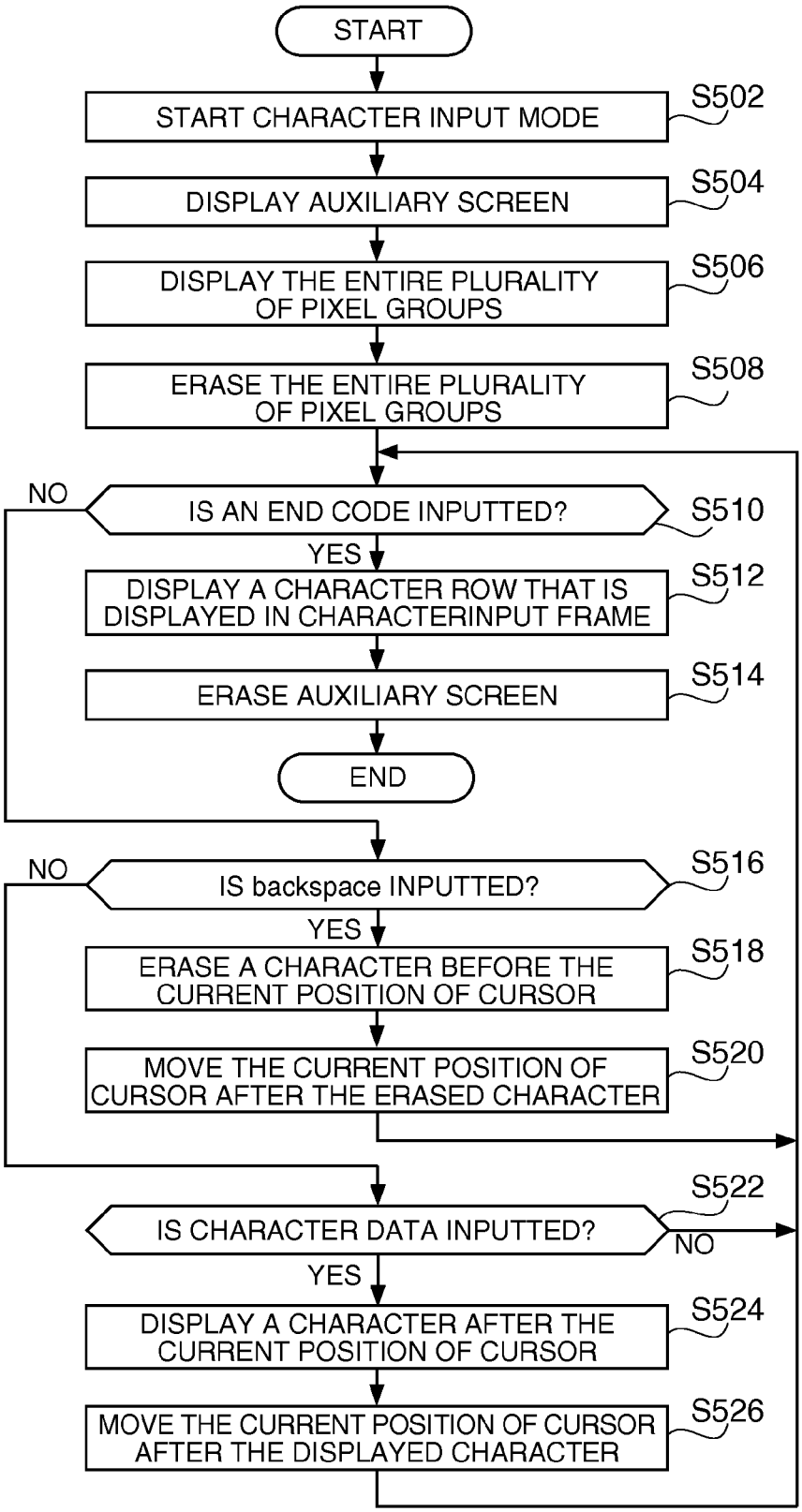
FIG. 5 is a flowchart of an example of display control processing executed by a display control section 214.

FIG. 5 shows an example of the procedure of the display control processing (the processing in the display control procedure) executed by the display control section 214. Here, an example of the display control processing executed by the display control section 214 is described below, starting from the state in which the main screen 300 is displayed.

When a character input mode is started (step S502), the display control section 214 initially displays the auxiliary screen 310, superposed on the main screen 300 that has already been displayed on the display 120 (step S504). For example, the display control section 214 displays the auxiliary screen 310 having the character input frame 312, as shown in FIG. 3.

Then, the display control section 214 displays the entire plurality of pixel groups 402 included in the character input frame 312 (step S506). Then, the display control section 214 erases the display of the entire plurality of pixel groups 402 included in the character input frame 312 (step S508). By this, the display control section 214 generates afterimages at the entire plurality of pixel groups 402 included in the character input frame 312. The afterimages generated here will not spontaneously completely disappear until step S514 to be described below is executed.

Next, the display control section 214 judges as to whether or not an end code of the character input mode is inputted by the keyboard 115 (step S510). When it is judged, in step S510, that "the end code of the character input mode is inputted" (step S510: Yes), the display control section 214 displays a row of characters displayed in the character input frame 312 on the main screen 300 (step S512). Then, the display control section 214 erases the display of the auxiliary screen 310 (step S514), and ends the display control processing. On the other hand, when it is judged, in step S510, that "the end code of the character input mode is not inputted" (step S510: No), the display control section 214 advances the processing to step S516.

In step S516, the display control section 214 judges as to whether or not a "backspace command is inputted" by the keyboard 115 (step S516). In step S516, when it is judged that the "backspace command is inputted" (step S516: Yes), the display control section 214 erases the display of a character before the current position of the cursor displayed in the character input frame 312 (step S518), and moves the current position of the cursor to a position before the erased character (step S520). Then, the display control section 214 returns the processing to step S510. On the other hand, when it is judged, in step S516, that the "backspace command is not inputted" (step S516: No), the display control section 214 advances the processing to step S522.

In step S522, the display control section 214 judges as to whether or not character data is inputted by the keyboard 115 (step S522). When it is judged, in step S522, that the "character data is inputted" (step S522: Yes), the display control section 214 displays a character according to the inputted character data in a partial region 400 after the current position of the cursor displayed in the character input frame 312 (step S524). Then, the display control section 214 moves the cursor to a position after the partial region 400 that displays the character (step S526), and returns the processing to step S510. On the other hand, when it is judged in step S522 that the "character data is not inputted" (step S522: No), the display control section 214 returns the processing to step S510.

FIGS. 6-13 show display examples of characters executed by the display control processing. As shown in FIGS. 6-13, the character input frame 312 is provided with twenty partial regions 400 arranged laterally in a row. In other words, a maximum of 20 characters are displayed, arranged laterally in a row, in the character input frame 312.

Figure 6:
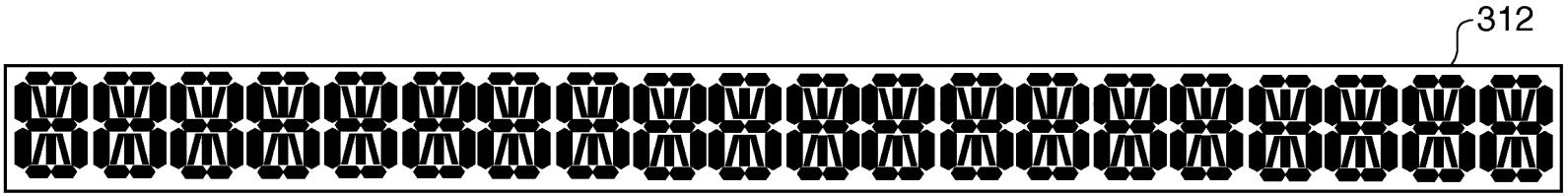
FIG. 6 is an example of character display performed by the display control processing.

First, the display control section 214 executes the processing in step S506 and step S508, thereby displaying the entire plurality of pixel groups 402 included in the character input frame 312, and then erase them, as shown in FIG. 6. More specifically, when black characters are to be displayed in white background, as shown in FIG. 4, a white color is preliminarily displayed with the entire pixels included in the character input frame 312. Then, in step S506, the display of the entire pixel groups 402 is switched to a black color display. Further in step S508, the display of the entire pixel groups 402 is switched to a white color display. By the steps described above, an afterimage of the black image displayed in step S506 remains at the plural pixel groups 402 included in the character input frame 312. The afterimage obtained in step S508 may be referred to as an initial afterimage. It is noted that, in FIG. 7 and thereafter, in order to express relative thickness of afterimages generated in the character input frame 312 at a given time, for the sake of convenience, edges of relatively thin afterimages among the afterimages generated in the character input frame 312 are shown in dotted lines, and edges of relatively dark afterimages are shown in solid lines. Further, much darker afterimages are shown with edges in solid lines and hatched with oblique lines. Such a method of expressing afterimages expresses spatial distribution of thickness of afterimages generated at a given time, and does not express temporal changes in thickness of afterimages.

Figure 7:
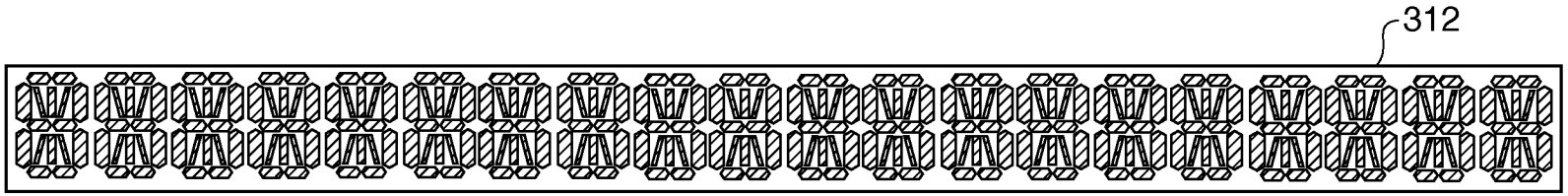
FIG. 7 is an example of character display performed by the display control processing.
Figure 8:
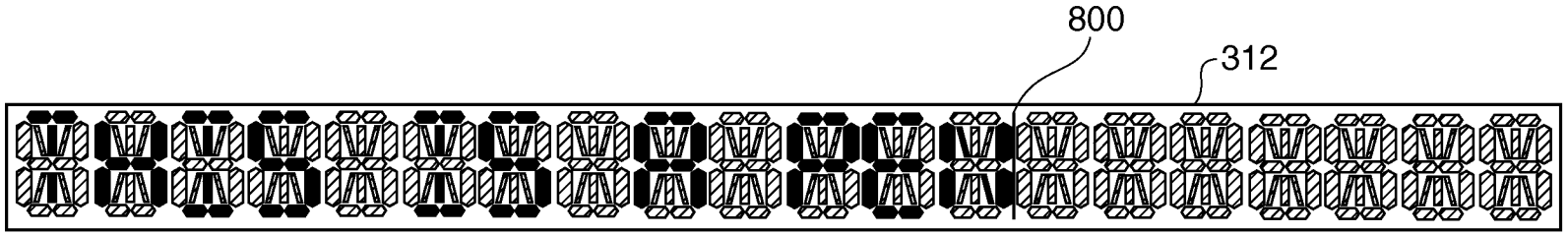
FIG. 8 is an example of character display performed by the display control processing.

When a row of characters "THIS IS A PEN" is inputted by the keyboard 115 in a state in which no character is displayed in the character input frame 312, the display control section 214 repeats the processing from step S522 to step S526 in the number of the characters in the character row (13 times), thereby displaying the character row "THIS IS A PEN" in the character input frame 312 as shown in FIG. 8, and moves the current position of the cursor 800 after the character row. By this step, the row of characters "THIS IS A PEN" is displayed in the character input frame 312, while the initial afterimage shown in FIG. 7 remains. At this moment, the row of characters "THIS IS A PEN" is displayed in the character input frame 312, overlapping the initial afterimage. It is noted that the plural pixel groups 402 composing the character row are a part of the plural pixel groups 402 that compose the initial afterimage. In this manner, images of the displayed characters overlap the initial afterimage in the unit of each pixel group 402. Also, a new image is displayed, using the pixel groups 402 with the initial afterimage remained, such that a portion of the initial afterimage is overwritten by an image to be displayed. Those of the pixel groups 402 that do not overlap the row of characters have the afterimage remaining, such that the display concentration of those pixel groups 402 is lower than the display concentration of the pixel groups 402 that overlap the row of characters, and the initial afterimage is generated in predetermined display segment configurations. As a result, the initial afterimage would not stand out, such that the user can readily recognize the character row "THIS IS A PEN" in the character input frame 312 without a feeling of wrongness.

Figure 9:
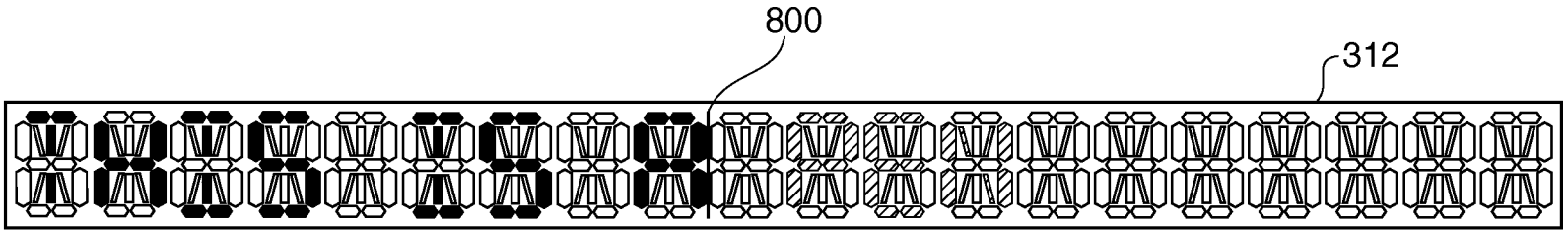
FIG. 9 is an example of character display performed by the display control processing.
Figure 10:
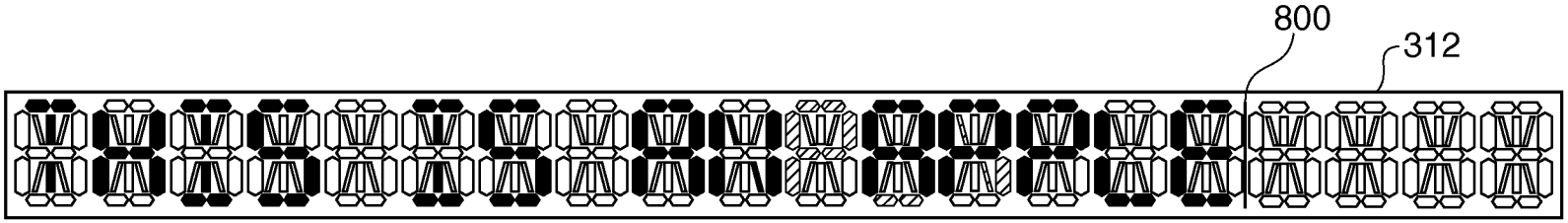
FIG. 10 is an example of character display performed by the display control processing.

Further, when a backspace command is inputted four times by the keyboard 115, the display control section 214 repeats the processing from step S516 to step S520 four times, thereby erasing the display of " PEN," and moving the current position of the cursor 800 after the remaining character row "THIS IS A," as shown in FIG. 9. As the display of "PEN" is erased, an afterimage of the characters "PEN" is added to the initial afterimage, such that the density distribution of the afterimage becomes uneven, as shown in FIG. 9.

Further, when a row of characters "N APPLE" is inputted by the keyboard 115, the display control section 214 repeats the processing from step S522 to step S526 in the number of the characters in the character row (seven times), thereby displaying a row of characters "N APPLE" after the row of characters "THIS IS A" which is already displayed, and moving the current position of the cursor 800 after the row of characters "N APPLE." At this moment, a row of characters "THIS IS AN APPLE" is displayed in the character input frame 312, overlapping the afterimage of the erased row of characters "PEN," and the displayed image of the characters overlaps the afterimage in the unit of each pixel group 402. The display density of those of the pixel groups 402 that do not overlap the row of characters and have the afterimage remaining is lower than the display density of those of the pixel groups 402 that overlap the row of characters. Moreover, these afterimages are generated in the predetermined display segment configurations. Therefore, these afterimages would not stand out, and the user can readily recognize the row of characters "THIS IS AN APPLE" in the character input frame 312 without a feeling of wrongness.

Further, when the backspace command is inputted sixteen times by the keyboard 115, the display control section 214 repeats the processing from step S516 to step S520, thereby erasing the display of the row of characters "THIS IS AN APPLE," and moving the current position of the cursor 800 to the head of the character input frame 312. As the display of the row of characters "THIS IS AN APPLE" is erased, an afterimage of the characters "THIS IS AN APPLE" is added to the initial afterimage and the afterimage of the characters "PEN" such that the density distribution of the afterimage becomes more uneven, as shown in FIG. 11.

Further, when a row of characters "IS THIS AN ORANGE?" is inputted by the keyboard 115, the display control section 214 repeats the processing from step S522 to step S526 in the number of the characters in the row of characters (eighteen times), thereby controlling the character input frame 312 to display the row of characters "IS THIS AN ORANGE?" and moving the current position of the cursor 800 after the row of characters. At this moment, the row of characters "IS THIS AN ORANGE?" is displayed in the character input frame 312, overlapping the initial afterimage, the afterimage of the row of characters "PEN" and the afterimage of the row of characters "THIS IS AN APPLE." It is noted that the displayed image of the characters overlaps the afterimage in the unit of each pixel group 402. The display density of those of the pixel groups 402 that do not overlap the row of characters and have the afterimage remaining is lower than the display density of those of the pixel groups 402 that overlap the row of characters. Moreover, these afterimages are generated in the predetermined display segment configurations. Therefore, these afterimages would not stand out, and the user can readily recognize the row of characters "IS THIS AN ORANGE?" in the character input frame 312 without a feeling of wrongness.

Figure 11:
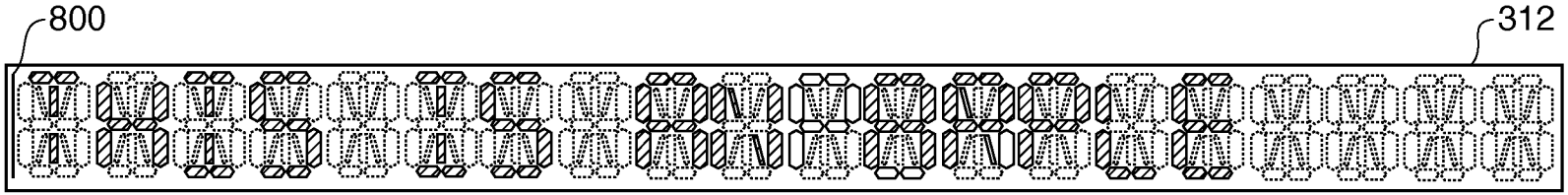
FIG. 11 is an example of character display performed by the display control processing.
Figure 12:
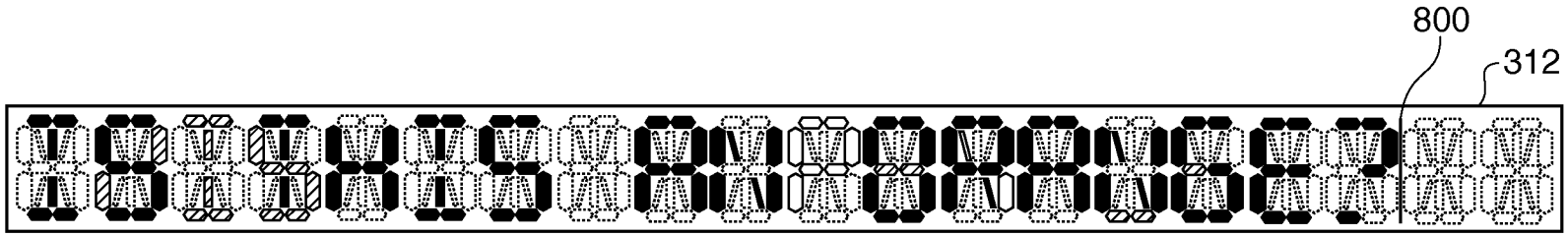
FIG. 12 is an example of character display performed by the display control processing.

When the characters "IS THIS AN ORANGE?" are displayed in the character input frame 312 through the process shown in FIG. 6 through FIG. 12, the afterimage of the characters "THIS IS AN APPLE" and the afterimage of the characters "PEN" are added to the initial afterimage, such that the density distribution of the afterimages is uneven, as shown in FIG. 11. However, these afterimages are generated in the predetermined display segment configurations, such that, even when afterimages of various characters are accumulated, the user can readily recognize the row of characters displayed in the character input frame 312 without a feeling of wrongness.

Figure 13:
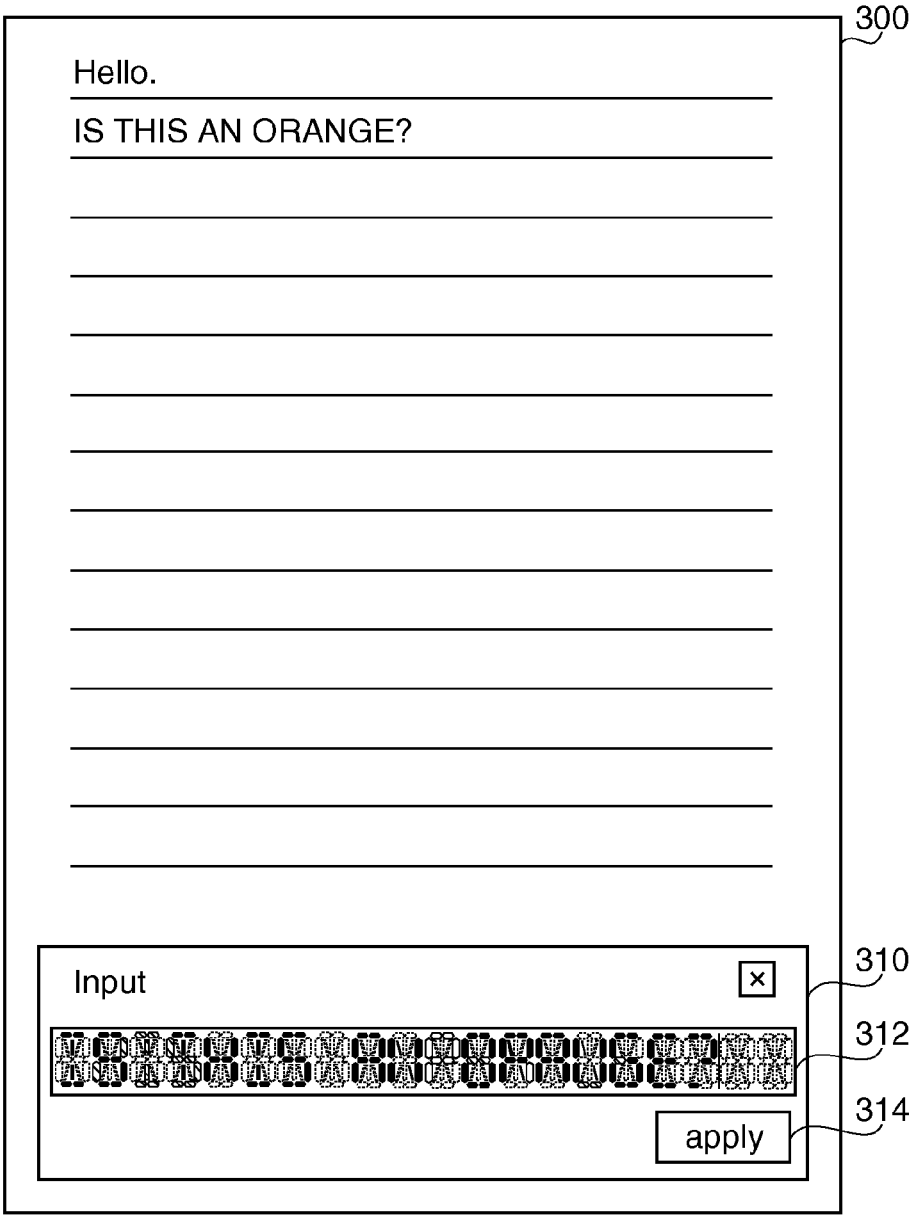
FIG. 13 is an example of character display performed by the display control processing.

Then, as shown in FIG. 13, as the confirmation button 314 is depressed in the state in which the row of characters "IS THIS AN ORANGE?" is displayed in the character input frame 312, the display control section 214 displays the row of characters "IS THIS AN ORANGE?" at a predetermined position in the main screen 300. Then, the display control section 214 may erase the display of the auxiliary screen 310, or maintain the auxiliary screen 310 to be displayed.

In this manner, the display control section 214 uses a plurality of pixel groups 402 each having a predetermined display segment configuration to display characters in the character input frame 312. By this, afterimages of erased characters can be displayed in the unit of each pixel group 402 having the predetermined display segment configuration. Also, afterimages of erased characters and newly inputted characters can be displayed overlapping each other in the unit of each pixel group 402. As a result, afterimages of erased characters can be made inconspicuous, and a feeling of wrongness that may be perceived by the user can be alleviated.

Second Embodiment

Figure 14:
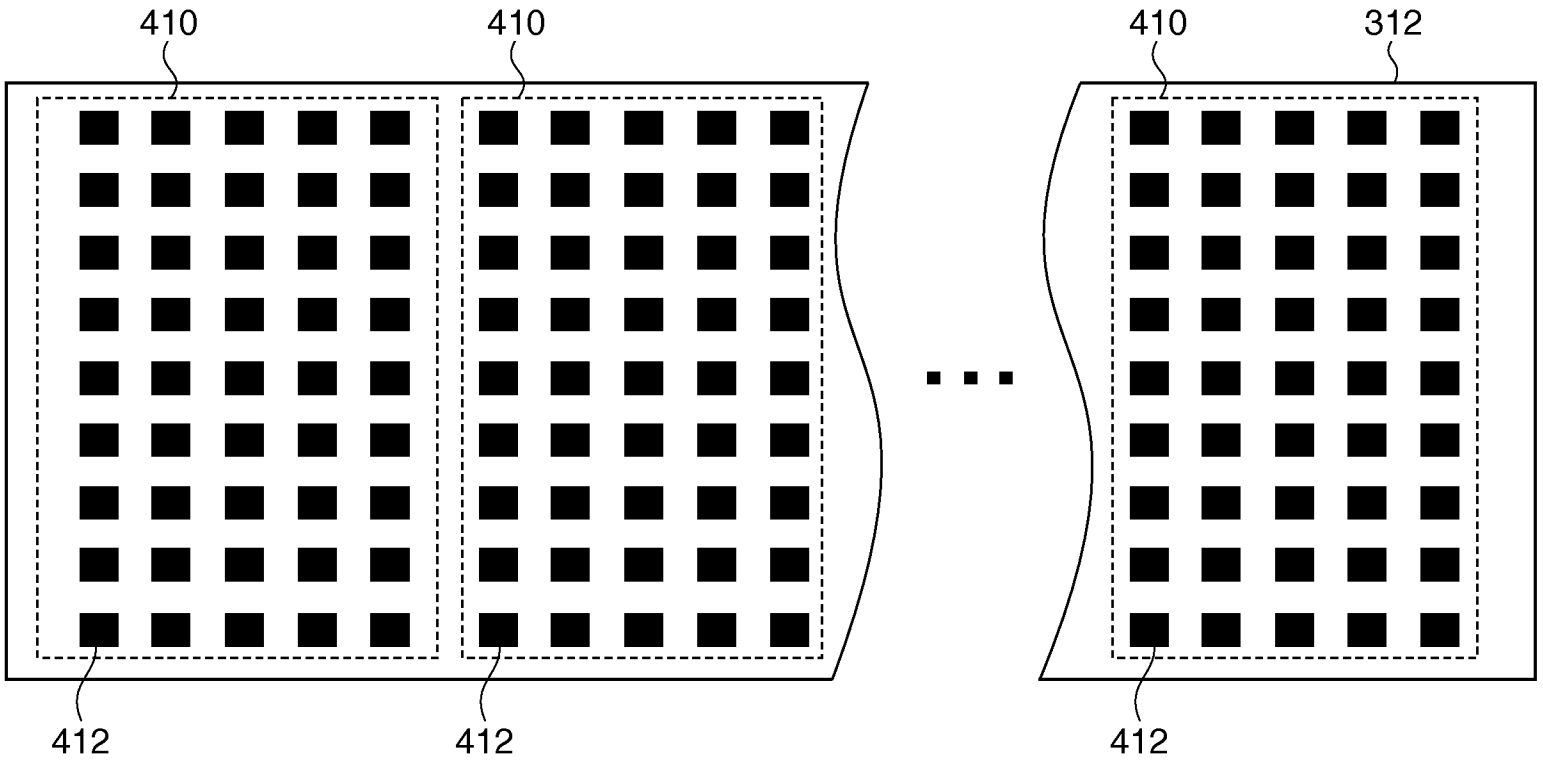
FIG. 14 shows another exemplary composition of a character input frame 312.

Next, Embodiment 2 of the invention will be described. Embodiment 1 has been described as to an example in which pixel groups are defined by display segment configurations. Embodiment 2 will be described as to an example in which pixel groups are defined by dot configurations. FIG. 14 shows another exemplary structure of the character input frame 312. In the character input frame 312, plural partial regions 410 are laterally arranged in one row with predetermined gaps provided therebetween. The display control section 214 controls each of the partial regions 410 to display a single character. Each of the partial regions 410 includes a plurality of pixel groups 412. In the example shown in FIG. 14, each of the plural pixel groups 412 has a dot configuration. FIG. 14 shows an example in which the entire pixel groups 412 are driven to display. In FIG. 14, colored portions indicate regions composed of plural pixels to be used for displaying characters (in other words, a plurality of pixel groups 412). On the other hand, uncolored portions indicate regions composed of plural pixels that are not to be used for displaying characters (in other words, regions other than the plurality of pixel groups 412). The display control section 214 selectively combines the plurality of pixel groups 412 to be displayed as characters.

As shown in FIG. 14, adjacent two of the pixel groups 412 are separated from each other as pixels that are not used for displaying characters (in other words, pixels that do not display characters or afterimages) are provided between them. Therefore, like Embodiment 1, the pixels that are not used for displaying characters are provided between the two adjacent pixel groups each having a uniform gradation level, respectively. Therefore, even when there is a difference in gradation level between the two adjacent pixel groups, the difference in gradation level is harder to be recognized. Accordingly, the unpleasant feeling that may be perceived by the user can be reduced.

The partial regions 410 and the plural pixel groups 412 may differ from one another in shape and size depending on the font size of characters to be displayed in the character input frame 312, and the complexity of the characters. For example, the greater the font size of characters to be displayed in the character input frame 312, the greater the size of each of the plural pixel groups 412 may be made, and the greater the size of the partial regions 410 may be made accordingly. As another example, the greater the font size of characters to be displayed in the character input frame 312, the greater the size of each of the partial regions 410 may be made, and the greater the number of pixel groups 412 within each of the partial regions 410 may be increased accordingly. As still another example, when more complex characters such as Kanji characters are to be displayed in the character input frame 312, the size of the pixel groups 412 within each of the partial regions 410 may be made smaller accordingly, and the number thereof may be increased.

Figure 15:
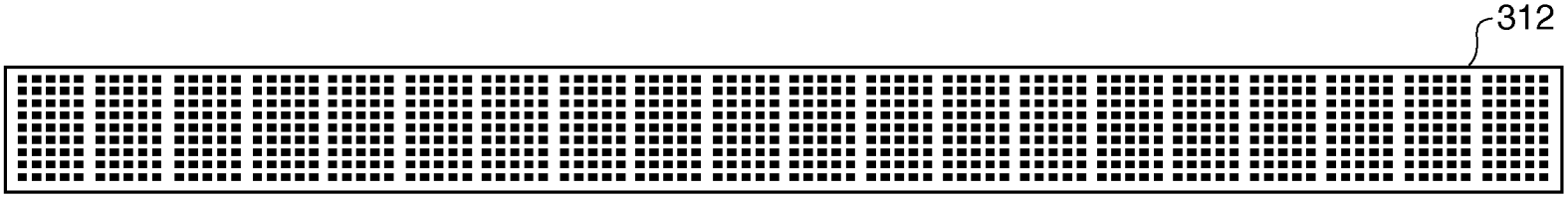
FIG. 15 is another example of character display performed by the display control processing.
Figure 16:
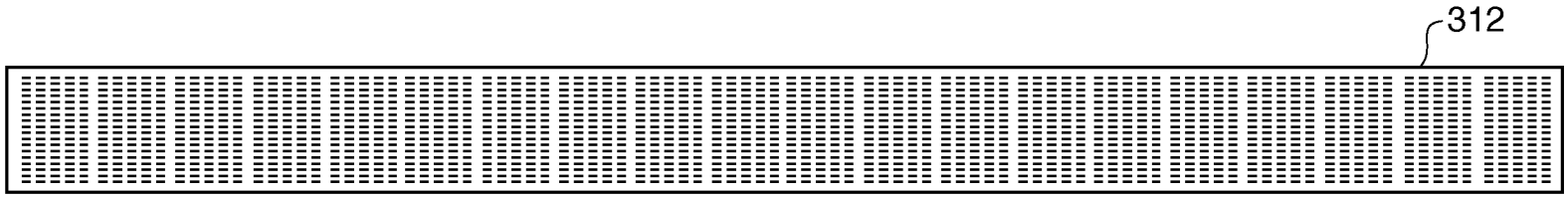
FIG. 16 is another example of character display performed by the display control processing.
Figure 17:
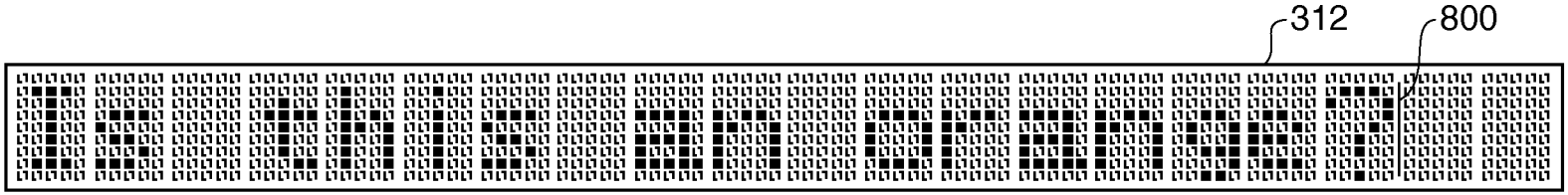
FIG. 17 is another example of character display performed by the display control processing.

FIGS. 15-17 show display examples of characters executed by the display control processing. As shown in FIGS. 15-17, the character input frame 312 is provided with twenty partial regions 410 arranged laterally in a row. In other words, a maximum of 20 characters are displayed, arranged laterally in a row, in the character input frame 312.

First, the display control section 214 executes the processing in step S506 and step S508, thereby displaying the entire plurality of pixel groups 412 included in the character input frame 312, and then erase them, as shown in FIG. 14. More specifically, when black characters are to be displayed in white background, as shown in FIG. 14, a white color is preliminarily displayed with the entire pixels included in the character input frame 312. Then, the display of the entire pixel groups 412 is switched to a black color display, as shown in FIG. 15. Then, the display of the entire pixel groups 412 is switched to a white color display. By the steps described above, an afterimage of the black image displayed remains at the plural pixel groups 412 included in the character input frame 312, as shown in FIG. 16. It is noted that in FIG. 16 and thereafter, afterimages are shown by dotted lines, for the sake of convenience.

When a row of characters "Is this an orange?" is inputted by the keyboard 115 in a state in which no character is displayed in the character input frame 312, the display control section 214 repeats the processing from step S522 to step S526 in the number of the characters in the row of characters (eighteen times), thereby controlling the character input frame 312 to display the row of characters "Is this an orange?" and moving the current position of the cursor 800 after the row of characters, as shown in FIG. 17. In the example shown in FIG. 17, the row of characters "Is this an orange?" is displayed in the character input frame 312, overlapping the initial afterimage shown in FIG. 16, and the image of the displayed characters overlaps the afterimage in the unit of each pixel group 412. The display density of those of the pixel groups 412 that do not overlap the row of characters and have the afterimage remaining is lower than the display density of those of the pixel groups 412 that overlap the row of characters. Moreover, these afterimages are generated in the predetermined dot configurations. Therefore, these afterimages would not stand out, and the user can readily recognize the row of characters "Is this an orange?" in the character input frame 312 without a feeling of wrongness.

In this manner, the display control section 214 uses a plurality of pixel groups 412 each having a predetermined dot configuration to display characters in the character input frame 312. By this, afterimages of erased characters can be displayed in the unit of each pixel group 412 having the predetermined dot configuration. Also, afterimages of erased characters and newly inputted characters can be displayed overlapping each other in the unit of each pixel group 412. As a result, afterimages of erased characters can be made inconspicuous, and a feeling of wrongness that may be perceived by the user can be alleviated.

Applicability of the display control method, the display control device, and the program in accordance with the invention is not limited to the display devices 100 in accordance with Embodiment 1 and Embodiment 2, but they are also applicable to various data processing devices that are capable of displaying characters in a display section. In particular, like the display devices 100 in accordance with Embodiment 1 and Embodiment 2, in any data processing devices having a display section that uses an electrophoretic system, afterimages of data prior to rewriting would likely remain at the time of rewiring the display screen. Therefore, such data processing devices can have higher efficiency with application of the display control method, the display control device or the program in accordance with the invention.

Figure 18:
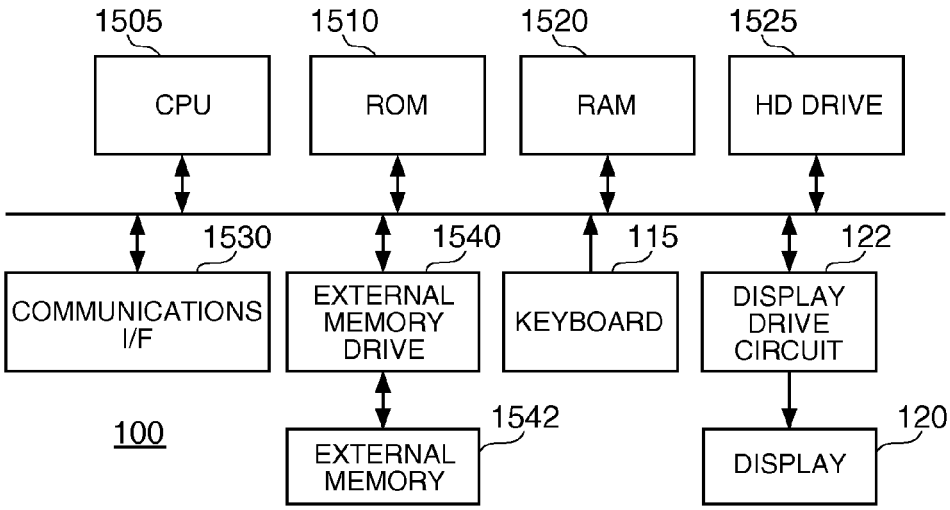
FIG. 18 shows an example of hardware composition of a display device 100.

FIG. 18 shows an example of hardware composition of a display device 100. The display device 100 is equipped with a CPU 1505, a ROM 1510, a RAM 1520, a HD (hard disk) drive 1525, a communications interface 1530, an external memory drive 1540 and an external memory 1542, in addition to the display 120, the display drive circuit 122 and the keyboard 115 described in FIG. 1.

The ROM 1510, the RAM 1520 and the HD drive 1525 store various kinds of data and various kinds of programs. The CPU 1505 executes the programs stored in the ROM 1510, the RAM 1520 or the HD drive 1525, thereby performing various kinds of data processing and various kinds of hardware control.

The communications interface 1530 connects to a communications network, and transmits and receives data through the communications network to and from an external device. The external memory drive 1540 connects to the external memory 1542, and transmits and receives data to and from the external memory 1542. As the external memory 1542, for example, a memory card may be used. The external memory 1542 may be a recording medium such as a flexible disk, a CD, a DVD or the like.

For example, the function of the character acquisition section 212 shown in FIG. 2 may be achieved through executing a display control program (a program in accordance with the present invention) stored in the ROM 1510, the RAM 1520 or the HD drive 1525 by the CPU 1505. Also, the function of the display control section 214 shown in FIG. 2 may be achieved through executing a display control program stored in the ROM 1510, the RAM 1520 or the HD drive 1525 by the CPU 1505, and controlling the display drive circuit 122 by the CPU 1505.

The display control program may be stored in the external memory 1542, or may be stored in a recording medium of an external device such as a memory, a hard disk or the like. Also, the display control program may be stored in advance in the ROM 1510, the RAM 1520 or the HD drive 1525. Also, the display control program may be provided to the display device 100 from the external memory 1542 or through the communications network from an external device.

Modification Examples

According to Embodiments 1 and 2, an afterimage is preliminarily displayed in each of the plural pixel groups, as described above in conjunction with FIG. 5 (step S506, step S508), FIG. 6 and FIG. 7. However, in accordance with a modified embodiment, the invention may be constituted without performing such processing. More specifically, in the modified embodiment, characters may be displayed in a state in which an afterimage is not displayed at each of the plural pixel groups. The modified embodiment is similar to Embodiment 1 and Embodiment 2 in that a plurality of pixel groups, each having a predetermined configuration, are used to display characters. Therefore, according to the modified embodiment also, when a row of characters has been erased and a new row of characters is displayed in the state in which an afterimage of the erased row of characters remains, the afterimage and the newly written row of characters overlap each other in the unit of each pixel group. Although the afterimage remains at those of the pixel groups that do not overlap the row of characters, the afterimage has a lighter display concentration than that of the pixel groups that overlap the row of characters, and is generated in the predetermined configurations (in segment configurations, dot configurations or the like), such that the afterimage would not stand out. Therefore, in accordance with the modified embodiment also, the user can readily recognize the newly written row of characters in the character display region without a feeling of wrongness.

The entire disclosure of Japanese Patent Application No. 2010-115761, filed May 19, 2010 is expressly incorporated by reference herein.

What is claimed is:

1. A display control method for controlling display of characters in a display section equipped with a plurality of pixels, the method comprising:

acquiring character data; and displaying a character according to the character data in a character display region of the display section, wherein the character corresponding to the character data is displayed in the character display region by using a plurality of pixel groups each having a predetermined shape, wherein prior to displaying the character according to the character data, an erasing process is performed on each of the plurality of pixel groups previously used to display previous character data, wherein each of the plurality of pixel groups is preliminarily displayed with a gradation level which is different from a gradation level at which the character data is to be displayed, such that any of the pixel groups that are not used for displaying the character data already have a generated afterimage generated by the different gradation level, wherein the erasing process is performed only on the plurality of pixel groups which were used to display previous character data without being performed on all the plurality of pixels in the display section, and wherein any afterimage generated upon erasing the previous character data is combined with the afterimage generated by displaying the pixel groups with the different gradation level during the erasing process in order to display the character data in the character display region.

2. A display control method according to claim 1, wherein the character display region has a plurality of partial regions each including a plurality of the pixel groups for displaying a character, and during displaying the character according to the character data in the character display region of the display section, one of the characters corresponding to the character data is displayed in one of the plurality of partial regions.

3. A display control method according to claim 1, wherein adjacent two of the pixel groups are separated from each other by providing pixels therebetween that are not used for displaying a character.

4. A display control method according to claim 1, wherein each of the plurality of pixel groups has a display segment configuration.

5. A display control method according to claim 1, wherein each of the plurality of pixel groups has a dot configuration.

6. A display control device for controlling display of characters in a display section equipped with a plurality of pixels, the display control device comprising:

a character acquisition section that acquires character data; and a display control section that displays a character according to the character data acquired by the character acquisition section in a character display region of the display section, the display control section using a plurality of pixel groups each having a predetermined shape to display a character corresponding to the character data acquired by the character acquisition section in the character display region, wherein prior to displaying the character according to the character data, an erasing process is performed on each of the plurality of pixel groups previously used to display previous character data, wherein each of the plurality of pixel groups is preliminarily displayed with a gradation level which is different from a gradation level at which the character data is to be displayed, such that any of the pixel groups that are not used for displaying the character data already have a generated afterimage generated by the different gradation level, wherein the erasing process is performed only on the plurality of pixel groups which were used to display previous character data without being performed on all the plurality of pixels in the display section, and wherein any afterimage generated upon erasing the previous character data is combined with the afterimage generated by displaying the pixel groups with the different gradation level during the erasing process in order to display the character data in the character display region.

7. A non-transitory computer-readable medium encoded with a computer program rendering a computer to function as a character acquisition device that acquires character data; and a display control device that displays a character according to the character data acquired by the character acquisition device in a character display region of a display section, the display control device using a plurality of pixel groups each having a predetermined shape to display a character corresponding to the character data acquired by the character acquisition device, wherein prior to displaying the character according to the character data, an erasing process is performed on each of the plurality of pixel groups previously used to display previous character data, wherein each of the plurality of pixel groups is preliminarily displayed with a gradation level which is different from a gradation level at which the character data is to be displayed, such that any of the pixel groups that are not used for displaying the character data already have a generated afterimage generated by the different gradation level, wherein the erasing process is performed only on the plurality of pixel groups which were used to display previous character data without being performed on all the plurality of pixels in the display section, and wherein any afterimage generated upon erasing the previous character data is combined with the afterimage generated by displaying the pixel groups with the different gradation level during the erasing process in order to display the character data in the character display region.

* * * * *